US008430533B1

(12) United States Patent
Blalock et al.

(10) Patent No.: US 8,430,533 B1
(45) Date of Patent: Apr. 30, 2013

(54) DEVICES AND METHODS FOR REPLACING LED LIGHT SOURCES FOR LED-BASED LUMINAIRES

(75) Inventors: Robert Allan Blalock, Peachtree City, GA (US); George Michael Drake, Newnan, GA (US)

(73) Assignee: Cooper Technologies Company, Houston, TX (US)

( * ) Notice: Subject to any disclaimer, the term of this patent is extended or adjusted under 35 U.S.C. 154(b) by 171 days.

(21) Appl. No.: 13/026,957

(22) Filed: Feb. 14, 2011

Related U.S. Application Data

(60) Provisional application No. 61/304,054, filed on Feb. 12, 2010.

(51) Int. Cl.
*F21V 3/00* (2006.01)
*F21V 29/00* (2006.01)
*F21V 19/00* (2006.01)

(52) U.S. Cl.
USPC . 362/294; 362/646; 362/311.02; 362/311.14; 362/373

(58) Field of Classification Search ..... 362/545, 362/547, 646, 658, 659, 249.02, 294, 311.01, 362/311.02, 311.14, 373, 800
See application file for complete search history.

(56) References Cited

U.S. PATENT DOCUMENTS

| | | | | |
|---|---|---|---|---|
| 7,338,186 | B1 * | 3/2008 | Wu et al. | 362/294 |
| 7,344,296 | B2 * | 3/2008 | Matsui et al. | 362/652 |
| 7,458,706 | B1 * | 12/2008 | Liu et al. | 362/373 |
| 7,527,397 | B2 * | 5/2009 | Li | 362/294 |
| 7,784,973 | B2 * | 8/2010 | Zhang et al. | 362/294 |
| 7,988,346 | B2 * | 8/2011 | Helms et al. | 362/545 |
| 8,109,653 | B2 * | 2/2012 | Mo | 362/249.02 |
| 8,109,654 | B2 * | 2/2012 | Mo | 362/249.02 |
| 8,172,425 | B2 * | 5/2012 | Wen et al. | 362/249.02 |
| 2009/0244894 | A1 * | 10/2009 | Zhou et al. | 362/249.02 |
| 2010/0079998 | A1 * | 4/2010 | Mrakovich et al. | 362/249.02 |
| 2010/0265709 | A1 * | 10/2010 | Liu | 362/249.02 |

OTHER PUBLICATIONS

Cree LED Lighting; LR6-DR1000; Specification Sheet; Oct. 2010.
Juno LED catalog; Juno LED Downlight Review; Jun. 2, 2009.
Philips, OEM Design-In Guide, Philips Fortimo LED DLM; Jan. 2010.
Cree LED Lighting; LED Module LMR4 with TrueWhite Technology; Apr. 6, 2010.
Portfolio Innovative LED Systems; Philips Lighting; Nov. 2010.
GE Lighting, Infusion LED Module, Jun. 2010.
Indy; Designer Series 6 110/2000 Lumen LED Round Downlight SD6 Series; Feb. 2011.

* cited by examiner

*Primary Examiner* — Ismael Negron
(74) *Attorney, Agent, or Firm* — King & Spalding LLP

(57) ABSTRACT

A LED holder includes a planar base member to releasably couple the holder to the heat sink of a luminaire. The LED holder also includes a substrate that is coupled to the planar base member and has one or more LEDs disposed on the substrate and electrically coupled to the substrate. The substrate can be a printed circuit board and the LEDs can be discrete LEDs or an LED package. A cover panel is removably coupled to the planar base member and is designed to prevent access to the substrate and the LEDs when the luminaire powered on. The LED holder can also include a LED cover positioned over the LEDs and within the cover panel to limit access to the top side of the LEDs while permitting light emitted by the LEDs to pass through the LED cover.

17 Claims, 4 Drawing Sheets

LED Holder installed

LED Holder

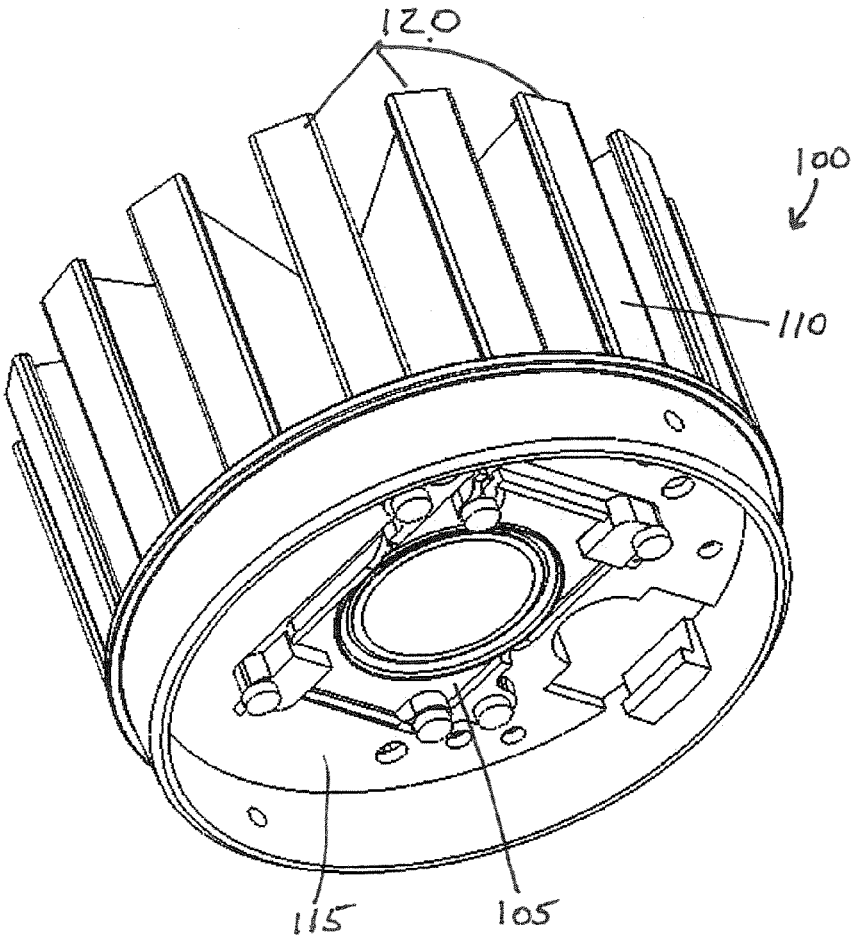
Figure 1: LED Holder installed
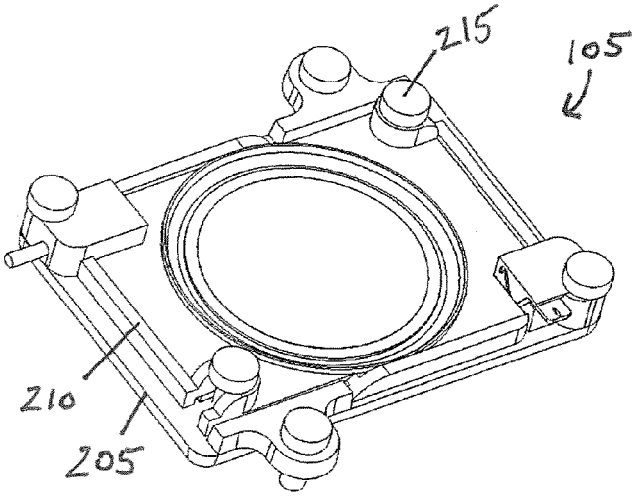
Figure 2: LED Holder

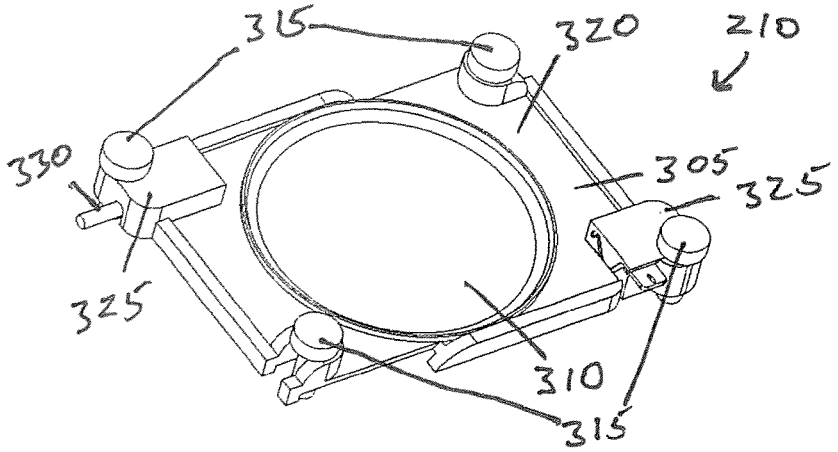
Figure 3: LED Holder, Protective Cover
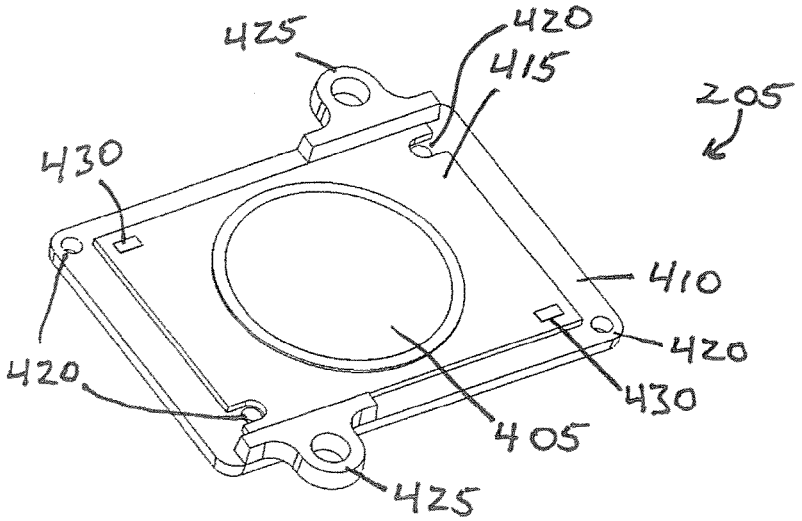
Figure 4: LED Holder, Base plate (with LED chip installed)

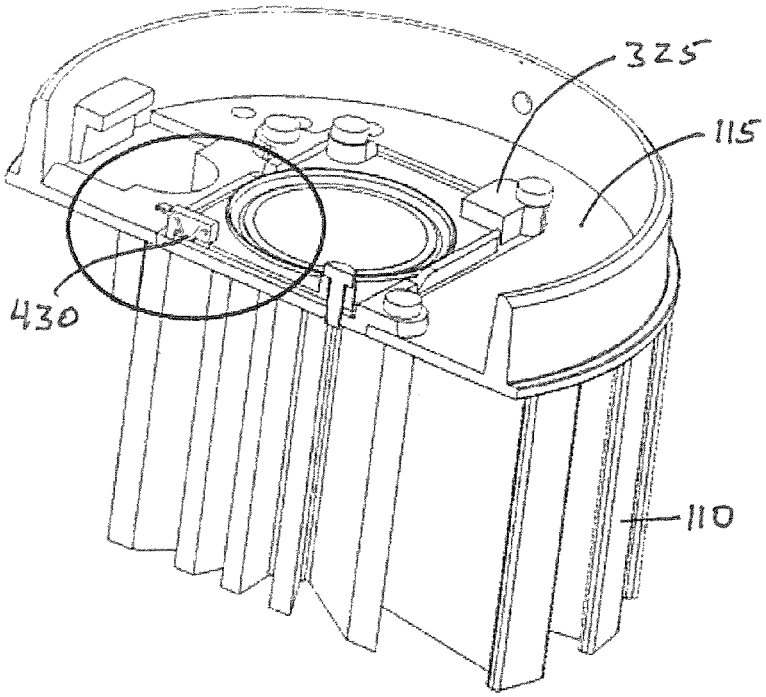
Figure 5: LED Holder, Section View illustrating Typical Contact with Solder Pad
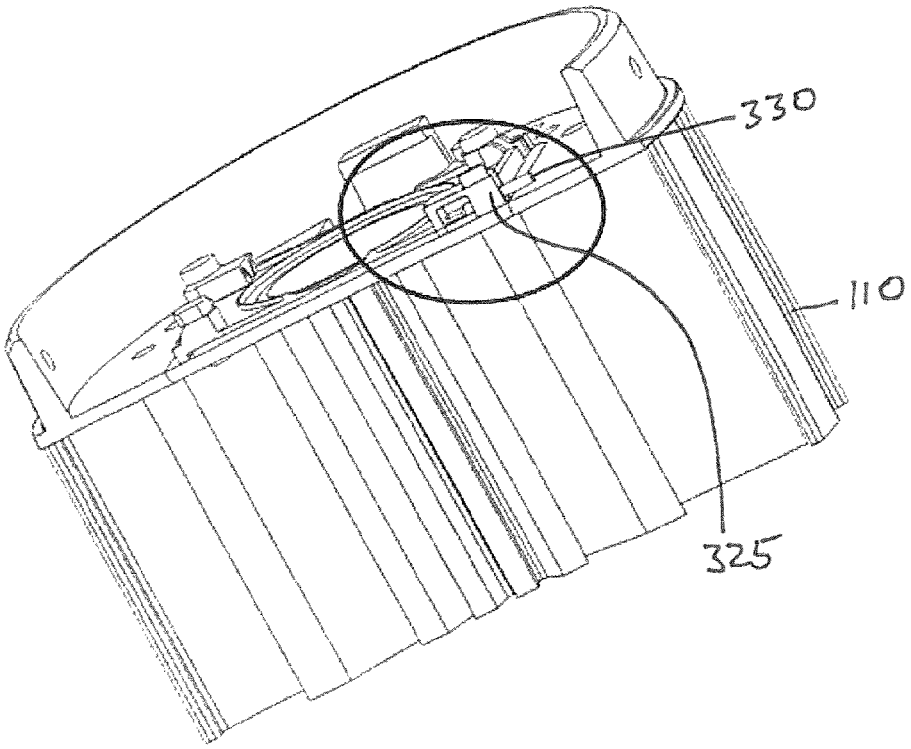
Figure 6: LED Holder, Section View illustrating Protective cover for Solder Connection

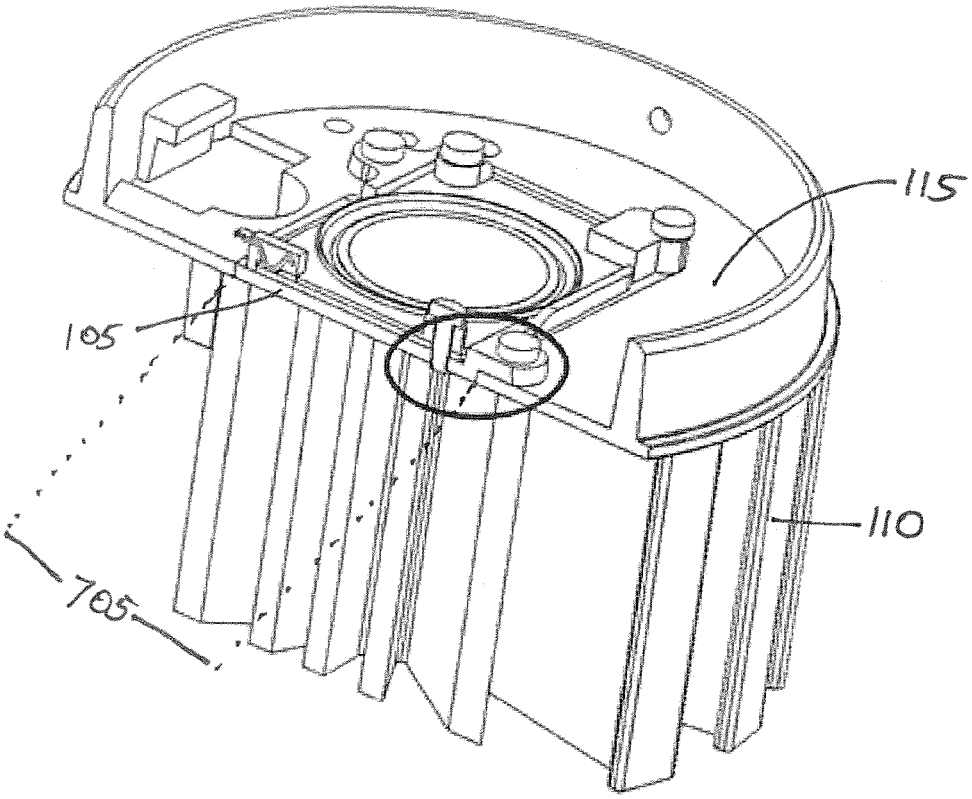
Figure 7: LED Holder, Section View illustrating LED Holder nesting within Heatsink

DEVICES AND METHODS FOR REPLACING LED LIGHT SOURCES FOR LED-BASED LUMINAIRES

RELATED PATENT APPLICATION

This patent application claims priority under 35 U.S.C. §119 to U.S. Provisional Patent Application No. 61/304,054, titled "LED Holder and Replaceable LED Light Source for LED-Based Luminaires" and filed Feb. 12, 2010, the complete disclosure of which is hereby fully incorporated herein by reference.

TECHNICAL FIELD

The present invention relates generally to luminaires. More specifically, the embodiments of the invention relate to systems, methods, and devices for providing an interchangeable light emitting diode (LED) light source in a luminaire.

BACKGROUND

A luminaire is a system for producing, controlling, and/or distributing light for illumination. For example, a luminaire can include a system that outputs or distributes light into an environment, thereby allowing certain items in that environment to be visible. Luminaires are often referred to as "light fixtures".

A recessed light fixture is a light fixture that is installed in a hollow opening in a ceiling or other surface. A typical recessed light fixture includes hanger bars fastened to spaced-apart ceiling supports or joists. A plaster frame extends between the hanger bars and includes an aperture configured to receive a lamp housing or "can" fixture. Traditional recessed light fixtures include a lamp socket coupled to the plaster frame and/or the can fixture. The lamp socket receives an incandescent lamp or compact fluorescent lamp ("CFL"). As is well known in the art, the traditional lamp screws into the lamp socket using an Edison screw to complete an electrical connection between a power source and the lamp.

Increasingly, lighting manufacturers are being driven to produce energy efficient alternatives to incandescent lamps. One such alternative was the CFL discussed above. CFLs fit in existing incandescent lamp sockets and generally use less power to emit the same amount of visible light as incandescent lamps. However, CFLs include mercury, which complicates disposal of the CFLs and raises environmental concerns.

Another mercury-free alternative to incandescent lamps is the light emitting diode ("LED"). LEDs are solid state lighting devices that have higher energy efficiency and longevity than both incandescent lamps and CFLs. However, conventional LEDs do not fit in existing incandescent lamp sockets, and lack interchangeability. Interchangeability of the light source may be desired to change the wattage of the light source or to change various operating characteristics of the light source such as the color temperature of the light source. Furthermore, conventional LED luminaires typically include one or more LED light sources that are not replaceable. This is the case because the LED light sources are typically affixed to the heat sink with double-sided tape or arctic silver, making removal from the heat sink difficult. Therefore, when the LED light source fails, either prematurely or at the end of its anticipated life-cycle, replacement of the LED light source typically requires disassembling the luminaire to replace the bulk LED modules or, in some circumstances, the die cast heat sink. In other circumstances, replacement of the entire luminaire is necessary. Further, the LED light source is typically provided on as a chip package with the LEDs located on a thin PCB circuit board. The fragile nature of such LED packages leaves the LEDs subject to damage during product manufacturing, packaging, shipping, and/or installation. Further, LED chip packages can be subject to potential damage from electrostatic discharge (ESD) during installation and/or replacement.

SUMMARY OF THE INVENTION

According to an embodiment of the invention, there is disclosed an LED holder that includes a planar base member having one or more fasteners for releasably coupling the LED holder to a heat sink. The LED holder further includes a substrate coupled to the planar base member with one or more LEDs disposed on the substrate and electrically coupled to the substrate, and a cover removably coupled to the planar base member and configured to prevent access to the substrate and the LEDs.

In accordance with one aspect of the invention, the LEDs are configured on an LED package. According to another aspect of the invention, the substrate comprises a printed circuit board. In accordance with yet another aspect of the invention, the cover comprises a cover panel configured to prevent access to a top and one or more of the sides of the substrate, and an LED cover positioned over the LEDs and disposed within the cover panel to prevent access to a top side of the LEDs, where the LED cover permits light emitted by the LEDs to pass therethrough. According to another aspect of the invention the cover further include at least one raised panel on a parallel plane to and vertically offset from the cover panel and disposed above a solder pad for the substrate when the cover is coupled to the planar base member, where the raised panel limits access to the solder pad when the cover is coupled to the planar base member. In accordance with yet another aspect of the invention, the LED holder further includes at least one flange disposed on the cover panel and extending generally vertically upward therefrom, where the flange is configured to receive and position an optic over the LED holder. According to another aspect of the invention, at least one flange includes an aperture for receiving at least one of the fasteners. In accordance with yet another aspect of the invention, at least one fastener comprises a quick release fastener means. According to another aspect of the invention, the planar base member or the cover contains at least one electrical contact.

In accordance with another embodiment of the invention, there is disclosed a luminaire that includes a heat sink that includes a heat sink base and multiple heat sink fins, and an LED holder removably coupled to the heat sink. The LED holder includes a planar base member having one or more fasteners for releasably coupling the LED holder to a heat sink, a substrate coupled to the planar base member with one or more LEDs disposed on the substrate and electrically coupled to the substrate, and a cover removably coupled to the planar base member and configured to prevent access to the substrate and the LEDs.

According to one aspect of the invention, the luminaire further includes an LED driver, and one or more wires electrically coupled on one end to the LED driver and electrically coupled along a second opposing end to the substrate to transmit electricity from the LED driver to the substrate. In accordance with another aspect of the invention, the luminaire further includes at least one solder connection cover, a spade-type wire connection for toollessly receiving and holding a wire lead associated with at least one of the wires, and at least one electrical contact for providing electrical communication between the wire lead and the substrate. According to yet another aspect of the invention, the LED holder is removably coupled to the head sink base. In accordance with another aspect of the invention, the heat sink base includes a cavity configured to receive the planar base member of the LED holder. According to yet another aspect of the invention, at least one fastener comprises a quick release fastener means. In accordance with another aspect of the invention, the luminaire further includes an LED driver, where the planar base member or the cover contains at least one electrical contact for supplying power to the substrate from the LED driver. According to yet another aspect of the invention, at least one fastener aligns the LED holder such that at least one electrical contact is aligned with at least one corresponding second electrical contact associated with the heat sink base or a connector associated with the heat sink base.

According to yet another embodiment of the invention, there is disclosed a method of removing an LED holder in a luminaire comprising the steps of decoupling a cover from an LED base, where the LED base includes a planar base member comprising a plurality of fasteners for releasably coupling the LED holder to a heat sink, a substrate coupled to the planar base member, and one or more LEDs disposed on the substrate and electrically coupled to the substrate. The method further includes removing the cover from the LED holder, electrically decoupling at least one wire from the substrate, and decoupling the LED base from a heat sink of the luminaire.

In accordance with one aspect of the invention, the method of removing an LED holder in a luminaire further includes the step of coupling a replacement LED holder to the luminaire, where the replacement LED holder includes a second LED base having a second planar base member with one or more fasteners for releasably coupling the LED holder to a heat sink, a second substrate coupled to the second planar base member, a second set of LEDs disposed on the second substrate and electrically coupled to the second substrate, and a second cover removably coupled to the second LED base. According to another aspect of the invention coupling a replacement LED holder to the luminaire includes coupling the second LED base to the heat sink, electrically coupling at least one wire to the second substrate, and coupling the second cover to the second LED base.

BRIEF DESCRIPTION OF THE DRAWINGS

Reference will now be made to the accompanying drawings, which are not necessarily drawn to scale, and wherein:

FIG. 1 is a perspective view of an LED luminaire with an LED holder in accordance with one exemplary embodiment of the present invention;

FIG. 2 is a perspective view of the LED holder in FIG. 1 in accordance with an exemplary embodiment of the present invention;

FIG. 3 is a perspective view of a protective cover for the LED holder of FIGS. 1 and 2 in accordance with an exemplary embodiment of the present invention;

FIG. 4 is a perspective view of a base plate for the LED holder of FIGS. 1 and 2 in accordance with an exemplary embodiment of the present invention;

FIG. 5 is a partial sectional view of the LED luminaire of FIG. 1 in accordance with an exemplary embodiment of the present invention;

FIG. 6 is another partial sectional view of the LED luminaire of FIG. 1 in accordance with an exemplary embodiment of the present invention; and FIG. 7 is another partial section view of the LED luminaire of FIG. 1 in accordance with an exemplary embodiment of the present invention.

DETAILED DESCRIPTION OF THE EXEMPLARY EMBODIMENTS

Embodiments of the present invention are directed to a removable and replaceable LED holder and LED light source for use in a luminaire. Referring now to FIGS. 1-7, the exemplary LED luminaire 100 includes an LED holder 105, a heat sink 110, and a heat sink base plate 115. As a byproduct of converting electricity into light, LEDs generate a substantial amount of heat that raises the operating temperature of the LEDs if allowed to accumulate. This results in efficiency degradation and premature failure of the LEDs. The heat sink 110 is configured to manage heat output by the LEDs in the LED holder 105. In particular, the heat sink 110 is configured to conduct heat away from the LEDs even when the LED luminaire 100 is installed in an insulated ceiling environment. The heat sink 110 is composed of any material configured to conduct and/or convect heat, such as die cast metal. In accordance with various example embodiments of the invention, the heat sink 110 may be shaped into various forms and configurations. As shown in the example embodiment of FIG. 1, the heat sink 110 includes several heat sink fins 120. In other embodiments of the invention the heat sink 110 could have no fins, be made of various thermally conductive materials, and/or have active components to transfer heat (e.g., a fans, electrical systems for thermal cooling, and the like).

According to the example embodiment shown in FIG. 7, the heat sink base plate 115 includes a substantially round member with a cavity 705 configured to receive a base 410 portion of the base plate 205. As shown in the example embodiment of FIG. 1, heat sink fins 120 extend in a substantially perpendicular manner from a bottom surface of the heat sink base plate 115 towards a top end of the heat sink 110. In one exemplary embodiment, the fins 120 of the heat sink 110 are spaced around a substantially central core of the heat sink 110. In one exemplary embodiment, the core is a member that is at least partially composed of a conductive material. The core can have any of a number of different shapes and configurations. For example, the core can be a solid or non-solid member having a substantially cylindrical or other shape. Each fin 120 includes a substantially straight member that extends towards an outer edge of the heat sink 110. In certain exemplary embodiments, the straight members of the fins 120 are substantially symmetrical to one another and extend directly from the core. The length of the straight portion of the fins 120 can vary based on the size of the heat sink 110, the size of the LED holder 105, the size and lumen output of the LEDs disposed thereon, and the heat dissipation requirements of the LED holder 105. In other embodiments of the invention, the heat sink fins may be rounded or a combination of straight and round members.

As best seen in the example embodiments of FIGS. 2-4, the LED holder is typically made up of two sections, the base plate 205 and the protective cover 210. The base plate 205 includes a base 410, a common substrate 415 coupled to the base 410 and an LED package 405 disposed on and electrically coupled to the common substrate 415. In one exemplary embodiment, the LED package 405 includes one or more LEDs mounted to the common substrate 415. The substrate 415 includes one or more sheets of ceramic, metal, laminate, circuit board, mylar, or other material. Each LED in the LED package 405 includes a chip of semi-conductive material that is treated to create a positive-negative ("p-n") junction. When the LED package 405 is electrically coupled to a power source, such as an LED driver, current flows from the positive side to the negative side of each junction, causing charge carriers to release energy in the form of light.

The wavelength or color of the light emitted from the LED package 405 depends on the materials used to make the LED package 405. For example, a blue or ultraviolet LED can include gallium nitride ("GaN") or indium gallium nitride ("InGaN"), a red LED can include aluminum gallium arsenide ("AlGaAs"), and a green LED can include aluminum gallium phosphide ("AlGaP"). Each of the LEDs in the LED package 405 can produce the same or a distinct color of light. For example, the LED package 405 can include one or more white LED's and one or more non-white LEDs, such as red, yellow, amber, or blue LEDs, for adjusting the color temperature output of the light emitted from the fixture 100. A yellow or multi-chromatic phosphor, nano-phosphor, or quantum dot material may coat or otherwise be used in a blue or ultraviolet LED to create blue and red-shifted light that essentially matches blackbody radiation. The emitted light approximates or emulates "white," incandescent light to a human observer. In certain exemplary embodiments, the emitted light includes substantially white light that seems slightly blue, green, red, yellow, orange, or some other color or tint. In certain exemplary embodiments, the light emitted from the LEDs in the LED package 405 has a color temperature between 2500 and 5000 degrees Kelvin.

In certain exemplary embodiments, an optically transmissive or clear material encapsulates at least a portion of the LED package 405 and/or each LED therein. This encapsulating material provides environmental protection while transmitting light from the LEDs. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors or quantum dot coatings are coated onto or dispersed in the encapsulating material for creating white light. In certain exemplary embodiments, the white light has a color temperature between 2500 and 5000 degrees Kelvin.

In certain exemplary embodiments, the LED package 405 includes one or more arrays of LEDs that are collectively configured to produce a specified lumen output often dependent on how the LEDs are driven (typically by varying current or voltage supplied by LED driver circuitry) in an area having less than two inches in diameter or in an area having less than two inches in length and less than two inches in width. By using a single, relatively compact LED package 405, the LED holder 105 has one light source that produces a specified lumen output that is equivalent to a variety of lamp types, such as incandescent lamps, compact fluorescent source, or other light sources, in a source that takes up a smaller volume within the luminaire 100. Although illustrated in FIGS. 1-7 as including LEDs arranged in a substantially round geometry, a person of ordinary skill in the art having the benefit of the present disclosure will recognize that the LEDs can be arranged in any geometry. For example, the LEDs can be arranged in square or rectangular geometries in certain alternative exemplary embodiments.

The LEDs in the LED package 405 are attached to the substrate 415 by one or more solder joints, plugs, epoxy or bonding lines, and/or other means for mounting an electrical/optical device on a surface. Similarly, the substrate 415 is mounted to the base 410 by one or more solder joints, plugs, epoxy or bonding lines, and/or other means for mounting an electrical/optical device on a surface. For example, the substrate 415 can be mounted to the base 410 by a two-part arctic silver epoxy or double-sided heat tape.

The substrate 415 is electrically connected to support circuitry and/or the LED driver for supplying electrical power and control to the LED package 405. For example, one or more wire leads 330, as shown in the example embodiment of FIG. 3, can couple opposite ends of the substrate 415 along solder pads 430 to the LED driver, thereby completing a circuit between the LED driver, substrate 415, and LED package 405. In certain exemplary embodiments, the LED driver is configured to separately control one or more portions of the LEDs in the LED package 405 to adjust light color, intensity, or other lighting characteristics.

As shown in the example embodiment of FIG. 4, base plate 205 also includes one or more flanges 425 disposed on and extending out from the base 410. Each flange 425 typically includes an aperture extending through the flange for receiving a fastener 215 for fastening the base plate 205 to the heat sink base plate 115. Examples of a fastener 215 include, but are not limited to, a screw, a bolt, a rivet, a cam-lock switch, a pushbutton plunger, or other device known to those of ordinary skill in the art having the benefit of this disclosure. In alternative embodiments of the invention, the flange 425 may accommodate (or be replaced with) other quick-release fastener means may also be used such as clips, springs, magnets, or the like. In one exemplary embodiment, the heat sink base plate 115 includes apertures that correspond with the apertures in each flange 425. In this exemplary embodiment, the apertures in the heat sink base plate 115 are threaded and the fasteners 215 are screws. In certain exemplary embodiments, the flanges 425 are vertically offset from the base 410 so that the base 410 is inserted into the cavity 705 (FIG. 7) of the heat sink base plate 115 and a bottom surface of each flange rests upon the top surface of the heat sink base plate. By positioning the base 410 into the cavity 705, the base plate 205 is in direct contact with the heat sink 110, thereby enabling improved thermal energy transmission from the base plate 205 to the heat sink 110. To further improve contact between the base 410 and the heat sink base plate 115 or the heat sink 110, a releasable adhesive (such as double-sided heat tape) can be applied to the bottom surface of the base 410 to increase the amount of surface area contact between the base 410 and the heat sink base plate 115 or the heat sink 110. In one exemplary embodiment, the base 410 is manufactured from a structurally rigid material. In other embodiments of the invention, the positions of one or more of the flanges 425 of the base 410 may be such that the wiring 330, or alternatively, electrical contacts contained on the LED holder 105 are aligned for either ease of connection to an LED driver or corresponding electrical contacts on the luminaire 100 (or an electrical connector associated with the luminaire 100).

In the example embodiment of FIG. 4, the base 410 also includes a plurality of apertures 420 that extend though the base 410. Each aperture 420 is configured to receive a fastener 315 for mechanically coupling the protective cover 210 to the base plate 205. Examples of a fastener 315 include, but are not limited to, a screw, a bolt, a rivet, a cam-lock switch, a pushbutton plunger, or other device known to those of ordinary skill in the art having the benefit of this disclosure. In one exemplary embodiment, the apertures 420 are threaded and the fasteners 315 are screws. Alternatively, the base 410 could be provided without the apertures 420 and the protective cover 210 could be coupled to the base plate 205 with an adhesive, magnet, clip, or other fastening means, or permanently affixed to the base plate 205 through welding or in one of many other ways known to those of ordinary skill in the art.

The protective cover 210 includes the board cover 305, the LED cover 310, multiple fasteners 315, and multiple solder connection covers 325. In an example embodiment of the invention, the board cover 305 is sized and configured such that when the protective cover 210 is coupled to the base plate 205, the board cover 305 substantially surrounds one or more of the sides and a top portion of the substrate 415 to protect the substrate 415 from exterior contact or contamination from the elements. Further, the LED cover 310 is sized and configured such that when the protective cover 210 is coupled to the base plate 205, the LED cover 310 substantially surrounds one or more of the sides and atop portion of the LED package 405. In one exemplary embodiment, the LED cover is made of a light transmissive material such as acrylic or polycarbonate, although other materials may be used. Further, in certain exemplary embodiments, the LED cover 310 may be shaped or configured to act as a optic (or lens) as well as a protective cover for the LED package 405 and allows light generated by the LED package 405 to pass through the LED cover 310 in either a modified or unmodified manner. The combination of the board cover 305 and the LED cover 310 protects the LED package 405 and the substrate 415 from direct contact and resulting damage from packaging, shipping, and/or handling or dropping of the LED holder 105 during installation.

The solder connection covers 325 provide an enclosure for receiving a wire lead 330 from a power source, such as an LED driver. The solder connection covers 325 are positioned on the protective cover 210 to cover the solder pads 430 on the substrate 415 of the base plate 205. In one exemplary embodiment, the solder connection covers 325 allow for the wire lead 330 to be soldered to the solder pad 430 and protects that solder connection from external tampering or contamination. In an alternative embodiment, the solder connection cover 325 includes contacts and contact points for toollessly receiving and holding the wire lead 330 and providing electrical communication between the wire lead 330 and the substrate 415. In another alternative embodiment, for ease of wiring, the solder connection covers 325 includes a spade-type wire connection for toollessly receiving and holding the wire lead 330 and contacts for providing electrical communication between the wire lead 330 and the substrate 415. In another alternative embodiment, as an alternative to the use of soldered wires, electrical contacts or pads may be contained on the LED holder 105 and aligned for either ease of connection to an LED driver or corresponding electrical contacts on the luminaire 100 (e.g., heat sink base plate 115, a cavity in the heat sink base plate 115, or an electrical connector associated with the luminaire 100, or other location).

Further, the protective cover 210 can be configured and shaped to aid in the centering of additional (primary or secondary) optical elements. This can be achieved by adding additional flanges that extend upward in a straight, angular, or curvilinear manner from the board cover 305 in a manner that is complementary to the shape of the additional optical element or elements. By designing the protective cover with a complementing geometry to that of an upper optic, it will assist in ensuring the proper placement of that optic with respect to the LED package, thereby providing for the desired light output from the luminaire 100. In other example embodiments of the invention, the protective cover 210 covers the LEDs for protection during shipping/installation and is removable by various means such as snap-fit connection to the base plate 205, screw-thread connection to the base plate 205, or other removable connection means. Additionally, in some example embodiments of the invention, the protective cover 210 prohibits handlers or installers of the LED Holder from damaging the LED package through electrostatic discharge (ESD). In other embodiments of the invention, ESD damage to the LED package may be avoided through the use of an accessory kit that including a jumper wire with clips or other means to provide a grounding connection during use and/or installation of the LED holder on a luminaire.

In use, when a user wants to change out the LED package 405 (either due to a desire to increase/decrease wattage, change the lumen output, change the color or CRI or other operating characteristic of the LED package 405, to change the color output from the LED package 405 or because the LED package 405 failed or is failing, either prematurely or at the end of its life cycle) the user will release the fasteners 315 holding the protective cover 210 over the base plate 205. The wire leads 330 are disconnected from the substrate 415. In the alternative, quick-connect features discussed above can be used in (or in place of) the solder connection covers 325 and the wire leads 330 can be removed from the LED holder 105 without the need to remove the protective cover 210. The user then releases the fasteners 215 that hold the LED holder 105 to the heat sink base plate 115 and removes the LED holder 105 from the luminaire 100. The user then will select another LED holder 105. If quick-connect features are used, the user fastens the LED holder 105 with the replacement LED package 405 to the heat sink base plate 115 with the fasteners 215. If the wires leads 330 are intended to be soldered to the substrate, the protective cover 210 is removed from the base plate 205. Then the base plate 205 is coupled to the heat sink base plate 115 with the fasteners 215. The wire leads 330 are soldered to the substrate 415. Then the protective cover 210 is coupled to the base plate 205 with the fasteners 315. As those of ordinary skill in the art will recognize, the steps in the method described above are not limited to the order in which they are described and the use of "then" in any portion of the description is not intended to require that one step be performed before another.

Although the inventions are described with reference to preferred embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those skilled in the art, and ways of constructing other embodiments of the present invention will suggest themselves to practitioners of the art. Therefore, the scope of the present invention is not limited herein.

What is claimed is:

1. An LED holder comprising:

a planar base member comprising at least one fastener for releasably coupling the LED holder to a heat sink;

a substrate coupled to the planar base member;

at least one LED disposed on the substrate and electrically coupled to the substrate; and a cover coupled to the planar base member and configured to prevent access to the substrate and the at least one LED, the cover comprising:

a cover panel configured to prevent access to a top and a plurality of sides of the substrate; and an LED cover positioned over the at least one LED and disposed within the cover panel to prevent access to a top side of the at least one LED, wherein the LED cover permits light emitted by the at least one LED to pass therethrough.

2. The LED holder of claim 1, wherein the at least one LED is configured on an LED package.

3. The LED holder of claim 1, wherein the substrate comprises a printed circuit board.

4. The LED holder of claim 1, wherein the cover further comprises at least one raised panel on a parallel plane to and vertically offset from the cover panel and disposed above a solder pad for the substrate when the cover is coupled to the planar base member, and wherein the raised panel limits access to the solder pad when the cover is coupled to the planar base member.

5. The LED holder of claim 1, wherein the at least one fastener includes at least one quick release fastener means.

6. The LED holder of claim 1, wherein the planar base member or the cover contains at least one electrical contact.

7. The LED holder of claim 1, further comprising at least one flange disposed on the cover panel and extending generally vertically upward therefrom, wherein the flange is configured to receive and position an optic over the LED holder.

8. The LED holder of claim 7, wherein the at least one flange includes an aperture for receiving the at least one fastener.

9. A luminaire comprising:
- a heat sink comprising:
  - a heat sink base; and
- an LED holder removably coupled to the heat sink, the LED holder comprising:
  - a planar base member comprising at least one fastener for releasably coupling the LED holder to the heat sink, wherein the heat sink base includes a cavity configured to receive the planar base member of the LED holder;
  - a substrate coupled to the planar base member;
  - at least one LED disposed on the substrate and electrically coupled to the substrate; and
  - a cover coupled to the planar base member and configured to prevent access to the substrate and the at least one LED.

10. A luminaire of 9, further comprising:
- at least one solder connection cover;
- a spade-type wire connection for toollessly receiving and holding a wire lead associated with a wire; and
- at least one electrical contact for providing electrical communication between the wire lead and the substrate.

11. The luminaire of claim 9, wherein the LED holder is removably coupled to the heat sink base.

12. The luminaire of claim 9, wherein the at least one fastener includes at least one quick release fastener means.

13. The luminaire of claim 9,
- wherein the planar base member or the cover contains at least one electrical contact for supplying power to the substrate.

14. The luminaire of claim 13, wherein the at least one fastener aligns the LED holder, wherein the at least one electrical contact is aligned with at least one corresponding second electrical contact associated with the heat sink base or a connector associated with the heat sink base.

15. A method of removing an LED holder in a luminaire comprising the steps of:
- decoupling a cover from an LED base, wherein the LED base comprises:
  - a planar base member comprising at least one fastener for releasably coupling the LED holder to a heat sink;
  - a substrate coupled to the planar base member;
  - at least one LED disposed on the substrate and electrically coupled to the substrate; and wherein the cover comprises:
  - a cover panel configured to prevent access to a top and a plurality of sides of the substrate; and
  - an LED cover positioned over the at least one LED and disposed within the cover panel to prevent access to a top side of the at least one LED, wherein the LED cover permits light emitted by the at least one LED to pass therethrough;
- removing the cover from the LED holder;
- electrically decoupling at least one wire from the substrate; and
- decoupling the LED base from a heat sink of the luminaire.

16. The method of claim 15, further comprising the step of coupling a replacement LED holder to the luminaire, wherein the replacement LED holder comprises:
- a second LED base comprising:
  - a second planar base member comprising a at least one fastener for releasably coupling the LED holder to a heat sink;
  - a second substrate coupled to the second planar base member;
  - a second at least one LED disposed on the second substrate and electrically coupled to the second substrate; and
- a second cover removably coupled to the second LED base.

17. The method of claim 16, wherein coupling a replacement LED holder to the luminaire comprises the steps of:
- coupling the second LED base to the heat sink;
- electrically coupling at least one wire to the second substrate; and
- coupling the second cover to the second LED base.

* * * * *